US007245841B2

(12) United States Patent
Akatsu et al.

(10) Patent No.: US 7,245,841 B2
(45) Date of Patent: Jul. 17, 2007

(54) ELECTROPHOTOGRAPHIC APPARATUS

(75) Inventors: Shinichi Akatsu, Ibaraki (JP); Junshin Sakamoto, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 188 days.

(21) Appl. No.: 10/917,471

(22) Filed: Aug. 13, 2004

(65) Prior Publication Data

US 2005/0105926 A1 May 19, 2005

(30) Foreign Application Priority Data

Sep. 5, 2003 (JP) ..... P2003-314018

(51) Int. Cl.
*G03G 15/00* (2006.01)
*G03G 15/01* (2006.01)

(52) U.S. Cl. ..... 399/49; 399/74; 399/301; 347/116

(58) Field of Classification Search ..... 399/49, 399/74, 301; 347/116
See application file for complete search history.

(56) References Cited

U.S. PATENT DOCUMENTS 6,701,117 B2 * 3/2004 Kaji ..... 399/301
2004/0141765 A1 * 7/2004 Shimura et al. ..... 399/49
2004/0208661 A1 * 10/2004 Kitagawa et al. ..... 399/49
2005/0163519 A1 * 7/2005 Takahashi ..... 399/49
2005/0232648 A1 * 10/2005 Nishizawa et al. ..... 399/49

FOREIGN PATENT DOCUMENTS

JP 2761287 3/1998
JP 3068865 5/2000

* cited by examiner

*Primary Examiner*—David M. Gray
*Assistant Examiner*—Joseph S. Wong
(74) *Attorney, Agent, or Firm*—McGinn IP Law Group, PLLC

(57) ABSTRACT

An image detector has an I/V converter for converting, into a voltage output., a current output as a result of a photoelectric element arranged in a traveling direction of an intermediate transfer belt having received light reflected from the intermediate transfer belt and light reflected from toner images formed on the intermediate transfer belt; a peak-hold unit for holding an output voltage into which the light reflected from the intermediate transfer belt has been converted by the I/V converter; and a computation unit for detecting a difference between the output voltage of the peak-hold unit and an output voltage into which the light reflected from the toner images of respective colors has been converted by the I/V converter.

20 Claims, 6 Drawing Sheets

(RELATED ART)
FIG. 10B1

(RELATED ART)
FIG. 10B2

(RELATED ART)
FIG. 10B3

(RELATED ART)
FIG. 10C1

(RELATED ART)
FIG. 10C2

(RELATED ART)
FIG. 10C3

(RELATED ART)
FIG. 10D1

(RELATED ART)
FIG. 10D2

(RELATED ART)
FIG. 10D3

ELECTROPHOTOGRAPHIC APPARATUS

BACKGROUND OF THE INVENTION

1. Field of the Invention

The present invention relates to a multicolor electrophotographic apparatus using an intermediate transfer belt.

2. Description of the Related Art

In association with a recent trend toward colorization and expedition of documents, faster color laser beam printers have been pursued rapidly.

A tandem color electrophotographic apparatus is mentioned as an example of a color printer. In this printer, toner of black (K), yellow (Y), magenta (M), and cyan (C) colors is used, and image forming means of respective colors are provided. Toner images formed on the respective image forming means are transferred to an intermediate transfer belt in a superimposing manner, to thus form a color image.

As shown in FIGS. 1A and 1B, in the electrophotographic apparatus adopting the tandem mechanism, a plurality of image forming means 102 to 105 independently and sequentially form different toner images on respective photosensitive drums, and the thus-formed toner images are transferred on an intermediate transfer belt 101 in a superimposing manner. Therefore, the electrophotographic apparatus of this type easily addresses a speedup in printing speed. However, a position where the toner image formed by the image forming means is to be transferred on the intermediate transfer belt 101 is easily displaced, and the electrophotographic apparatus involves a problem of occurrence of a phenomenon of registration offset (hereinafter called "registration offset"), that is, a phenomenon of offsets arising among the positions where the toner images of colors are to be superimposed on each other.

Among reasons for the registration offset, an initial reason is manufacturing tolerances of the respective image forming means and mount tolerances of the same; and a time-varying reason is thermal expansion or deformation of members attributable to changes in the internal temperature of the electrophotographic apparatus. When laser is used as exposure means to be provided within the image forming means, the phase of a polygon mirror varies from one image forming means to another, which is in turn responsible for a registration offset.

For instance, as shown in FIG. 2, the following technique has already been put forth as means for preventing occurrence of a registration offset. Specifically, registration patches 201, which are toner images to be used for controlling correction of registration, are formed in respective colors on the intermediate transfer belt 101. The amount of registration offset between toner images of respective colors is detected by means of registration patch detectors 112. On the basis of a detection result, exposure means corrects a write timing of a laser beam for forming a latent image on each image forming device and controls the phase of a polygon mirror.

A technique using photoelectric elements as position detection means has been proposed. This technique uses two photoelectric elements for detecting the position of a light beam; specifically, as shown in FIG. 4A, photoelectric elements 401, 402 are arranged. When the light beam has passed so as to cross the photoelectric elements 401, 402, light currents $I_{PD1}$, $I_{PD2}$ are output from the photoelectric elements 401, 402 while phases of the currents remain offset, as shown in FIG. 4B. At this time, even when fluctuations have arisen in the quantity of light of the light beam, a cross point between the light currents $I_{PD1}$, $I_{PD2}$ does not fluctuate and is held constant. However, when the light beam has not yet entered the photoelectric elements, light current values of the light currents $I_{PD1}$, $I_{PD2}$ remain close to each other, which induces faulty operation. As shown in FIG. 4C, when light does not enter the photoelectric elements, an output from one of the photoelectric elements is clamped to a predetermined voltage, whereby a difference arises between this output and an output from the other photoelectric element. As a result, detection of a cross point is performed such that Vo is output at only a point where the outputs from the two photoelectric elements 401, 402 cross each other, as shown in FIG. 4D (Japanese Patent No. 3,068,865).

However, under circumstances where positions are detected by means of the light reflected from the intermediate transfer belt and the light reflected from the registration patches formed thereon, when the photoelectric elements 401, 402 are arranged as shown in FIG. 10A and the patches formed on the intermediate transfer belt have crossed the photoelectric elements 401, 402, the light currents $I_{PD1}$, $I_{PD2}$ are output from the photoelectric elements 401, 402 while being out of phase with each other, by means of the light reflected from the intermediate transfer belt and the patches, such as that shown in FIG. 10B1. At this time, even when fluctuations have arisen in the quantity of reflected light, the cross point between the light currents $I_{PD1}$, $I_{PD2}$ does not fluctuate and is held constant. However, when the light reflected from the intermediate transfer belt falls on the photoelectric elements, the light current values of the light currents $I_{PD1}$, $I_{PD2}$ are close to each other, which is in turn responsible for faulty operation. Therefore, as shown in FIG. 10C1, when the light reflected from the intermediate transfer belt does not fall on the photoelectric elements, an output from one of the photoelectric elements is clamped to a predetermined voltage, whereby a difference arises between this output and the output from the other photoelectric element. Consequently, detection of a cross point can be performed only at a point where the outputs from the two photoelectric elements cross each other, as shown in FIG. 10D1. However, under circumstances where changes have arisen in the quantity of light reflected from the intermediate transfer belt for reasons of a characteristic of the intermediate transfer belt, fluctuations in the quantity of light of the light source, or the like and where the quantity of reflected light has increased as shown in FIG. 10B2, when the output is clamped to the predetermined voltage as shown in FIG. 10C2, the cross point between the light currents $I_{PD1}$, $I_{PD2}$ exists in a voltage range higher than the clamp voltage. As a result, a cross point is detected at a point differing from the cross point between the light currents $I_{PD1}$, $I_{PD2}$, as shown in FIG. 10D2. When the quantity of reflected light has decreased as a result of changes having arisen in the quantity of light reflected from the intermediate transfer belt for reasons of the characteristic of the intermediate transfer belt or fluctuations in the quantity of light of the light source, as shown in FIG. 10B3, and when the output is clamped at the predetermined voltage as shown in FIG. 10C3, the cross point between the light currents $I_{PDI}$, $I_{PD2}$ exists in a voltage range equal to or lower than the clamp voltage, and hence the light currents $I_{PD1}$, $I_{PD2}$ come close to each other, which is in turn responsible for faulty operation. Detection of a cross point is performed at the cross point between the light currents $I_{PDI}$, $I_{PD2}$ and at the intermediate transfer belt section, as shown in FIG. 10D2, which raises a problem of a failure to detect the cross point between the outputs of the two photoelectric elements.

There has also been put forward a technique for detecting the amount of offset by means of a CCD sensor employed as another means for detecting the amount of offset. This technique is to take toner images having different reflection characteristics as base materials at the time of formation of registration patches and to detect black patches which have no reflection areas and are formed on the base materials. However, patches of different colors are formed as base materials for detecting the black patches, which raises another problem of an increase in the quantity of toner consumption (see Japanese Patent No. 2,761,287).

SUMMARY OF THE INVENTION

The above-described related-art techniques lack allowance for fluctuations in the intermediate transfer belt, the reflectivities of the respective color patches, and the quantity of toner consumption and suffer a problem of a decrease in the accuracy of detection of patch positions, which is caused by faulty detection stemming from fluctuations in the intermediate transfer belt or faulty operation due to noise.

An object of the present invention is to provide an electrophotographic apparatus which improves the accuracy of detection of the amount of positional offsets in registration patches performed by detection means and which can provide an image free from color offsets.

The objective is achieved by means of an electrophotographic apparatus comprising: a plurality of image forming means which electrify a photosensitive member; which form electrostatic images, each being made up of an electrification potential portion and a discharge potential portion, on the photosensitive member by means of exposure means; and which develop the electrostatic latent images with toner, to thus form toner images on the photosensitive member; an intermediate transfer belt on which the toner images of different colors formed on the photosensitive member are sequentially transferred in an overlapping manner by means of the respective image forming means; and image detection means for detecting registration patches formed on the intermediate transfer belt with the color toner images, registration correction control for aligning positions of the color toner images being employed, wherein the image detection means comprises I/V conversion means for converting, into a voltage output, a current output as a result of a photoelectric element arranged in a traveling direction of the intermediate transfer belt having received light reflected from the intermediate transfer belt and light reflected from the toner images formed on the intermediate transfer belt; peak-hold means for holding an output voltage into which the light reflected from the intermediate transfer belt has been converted by the I/V conversion section; and computation means for detecting a difference between the output voltage of the peak-hold means and an output voltage into which the light reflected from the toner images of respective colors is converted by the I/V conversion section.

According to the present invention, the accuracy of detection of the amount of registration offset can be enhanced without being affected by fluctuations in an intermediate transfer belt and noise and without involvement of an increase in the amount of toner consumed for registration patches; printing free from color displacement becomes feasible, and hence high-quality color printing becomes possible.

BRIEF DESCRIPTION OF THE DRAWINGS

FIGS. 6A, 6B1 to 6B3, 6C1 to 6C3, and 6D1 to 6D3 are views showing operation for detecting the position of a patch in association with variations in a characteristic of an intermediate transfer belt in the electrophotographic apparatus of the invention;

FIGS. 10A, 10B1 to 10B3, 10C1 to 10C3, and 10D1 to 10D3 are views showing a patch position detection operation in association with a change in a characteristic of a related-art intermediate transfer belt;

DETAILED DESCRIPTION OF THE PREFERRED EMBODIMENTS

Embodiments of the invention will be described hereinbelow by reference to FIGS. 1 to 8 and FIGS. 11 to 17.

Figure 1A:
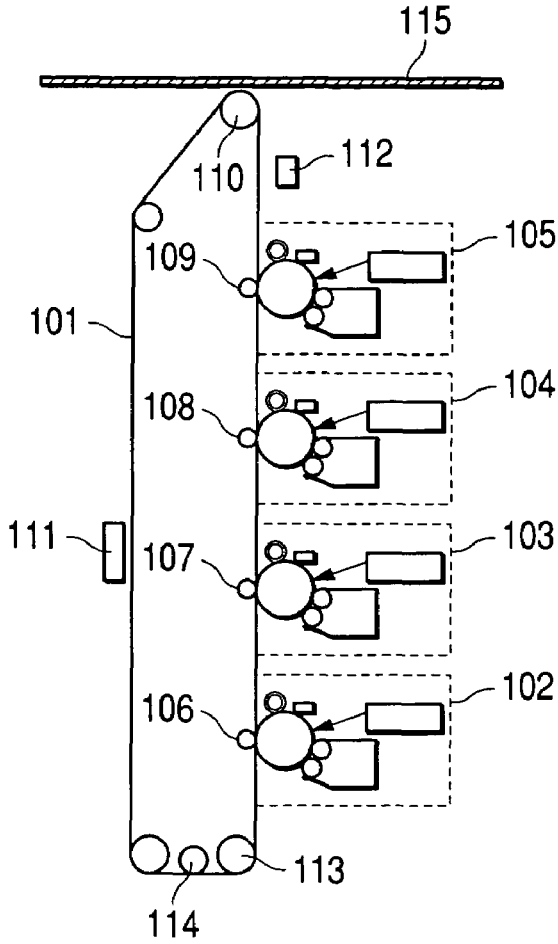
FIGS. 1A and 1B are schematic cross-sectional side views of an electrophotographic apparatus according to the invention.

FIG. 1A shows a schematic side view showing processes of an electrophotographic apparatus employing registration correction control according to the present invention. Reference numeral 101 designates an intermediate transfer belt; 102 designates first image forming means; 103 designates second image forming means; 104 designates third image forming means; 105 designates fourth image forming means; 106 to 109 respectively designate first transfer machines; 110 designates a second transfer machine; 111 designates a belt cleaner; 112 designates a registration patch detector; 113 designates a drive shaft; 114 designates a meandering correction roller; and 115 designates paper.

Figure 1B:
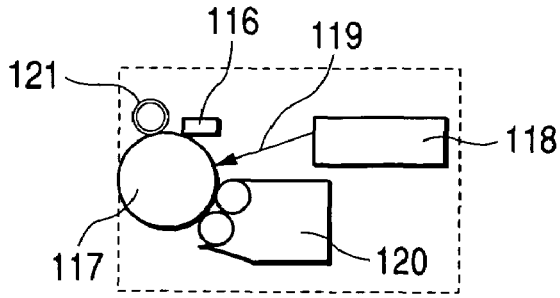
Figure 2:
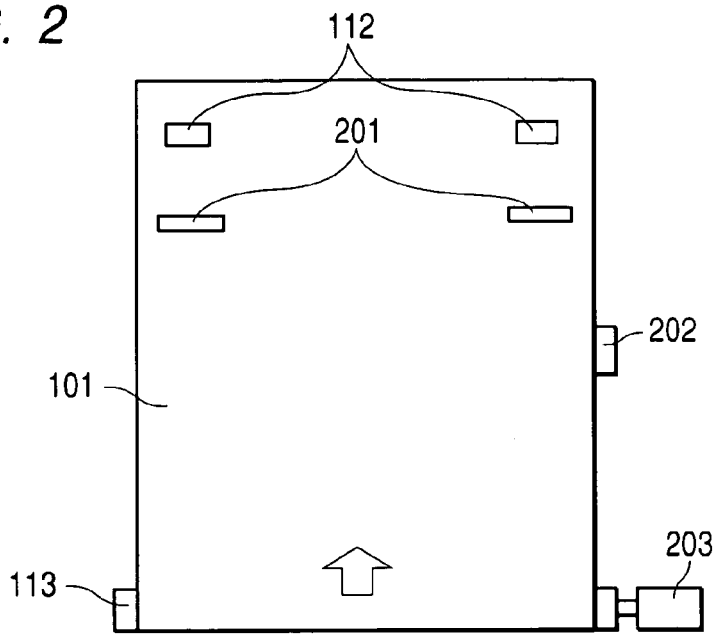
FIG. 2 is a block diagram of an intermediate transfer belt unit of the electrophotographic apparatus of the invention.

FIG. 1B is a detailed descriptive view of the image forming means 102 to 105. Reference numeral 116 designates an electrification device; 117 designates a photosensitive drum; 118 designates exposure means; 119 designates a laser beam; 120 designates a developing machine; and 121 designates a drum cleaner. FIG. 2 is a view showing the structure of an intermediate transfer belt unit, wherein reference numeral 201 designates a registration patch; 202 designates a belt edge detector; and 203 designates a belt drive motor.

The laser printer of the embodiment is equipped with the image forming means 102 to 105 which employ toner of black (K), yellow (Y), magenta (M), and cyan (C) colors and are provided for the respective colors, and the image forming means are uniformly spaced from each other and arranged vertically. Disposed beside the image forming means 102 to 105 is the intermediate transfer belt 101 on which the color toner images formed on the photosensitive drums 117 by the image forming means 102 to 105 are transferred in a superimposing manner.

Image forming operation will now be described by reference to FIG. 1A. The image forming means 102 uniformly electrifies the photosensitive drum 117 through use of an OPC which is negatively electrified by the electrification device 116. Next, the exposure means 118 emits a laser beam in accordance with image data, and the photosensitive drum 117 is exposed to the laser beam 119, whereupon a latent image is formed on the surface potential of the photosensitive drum 117.

Subsequently, the latent image formed on the photosensitive drum 117 is developed with toner by the developing machine 120, to thus form a toner image. Next, the toner image formed on the photosensitive drum 117 is transferred on the intermediate transfer belt 101 by the first transfer machine 106. Residual toner, which has not been transferred to the intermediate transfer belt 101 and still remains on the photosensitive drum 117, is recovered by the drum cleaner 121.

Likewise, the image forming means 103 to 105 equipped with different colors of toner also form toner images on the respective corresponding photosensitive drums 117, and the first transfer machines 107 to 109 transfer toner images of respective colors onto the intermediate transfer belt 101. The toner images of the respective colors superimposed on the intermediate transfer belt 101 are transferred onto the paper 115 by means of the second transfer machine 110.

Finally, residual toner, which has not been transferred to the paper 115 and still remains on the intermediate transfer belt 101, is recovered by the belt cleaner 111, to thereby complete a round of printing processes. At this time, a registration patch is detected as follows. Namely, the registration patch 201 is formed on the intermediate transfer belt 101, which is set to a transport speed by a belt drive motor control section 301 shown in FIG. 3, by means of the first transfer machine 106 shown in FIG. 1A. The registration patch 201 formed on the intermediate transfer belt 101, whose transport speed has been changed to a detection speed by the belt drive motor control section 301 after having passed by the first transfer machine 109, is sequentially detected by the registration patch detector 112 serving as image detection means. Information about the position of the detected registration patch is converted into the amount of registration offset in each of the primary and secondary scanning directions on the basis of a time difference between the registration patches of respective colors, and a write timing of the laser beam and the rotary phase of a polygon mirror are adjusted, to thus correct registration.

Figure 5:
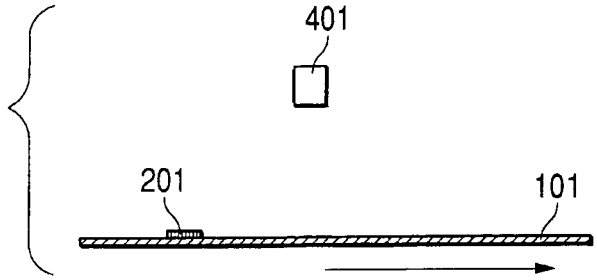
FIG. 5 is a layout of photoelectric elements of the electrophotographic apparatus of the invention.

Detection of a registration patch using photoelectric elements will be described hereinbelow. FIG. 5 is a view showing the arrangement and configuration of the photoelectric elements of the embodiment. Upon receipt of the light reflected from the intermediate transfer belt 101, a photoelectric element 401 usually outputs a light current. When the patch 201 formed on the intermediate transfer belt 101 has been transported in the direction of the arrow this time, the quantity of the light reflected from the patch 201, the patch being lower in reflectivity than the intermediate transfer belt 101, becomes smaller during the course of the patch 201 passing by the photoelectric element 401, whereupon a light current output from the photoelectric element 401 also becomes smaller.

Figure 6A:
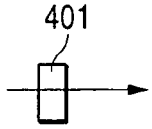
Figure 6A:
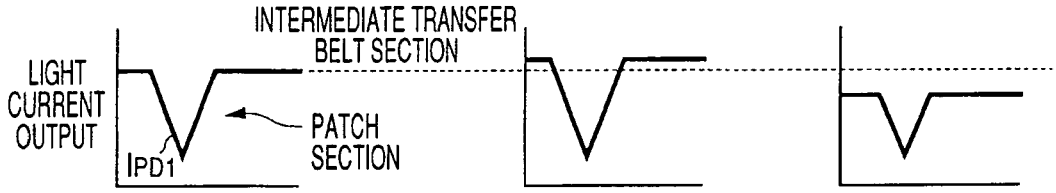
Figure 6A:
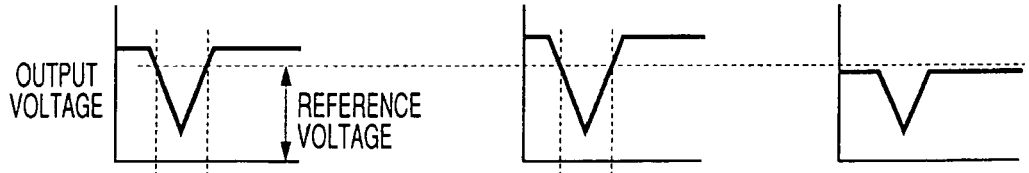
Figure 6A:
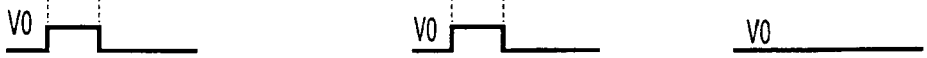

FIGS. 6A, 6B1 to 6B3, 6C1 to 6C3, and 6D1 to 6D3 are views showing operation of the photoelectric element 401 for detecting the position of the patch by means of the light current. When the light reflected from the intermediate transfer belt 101 and the light reflected from the patch 201 pass by the photoelectric element 401 in the direction of the arrow, as shown in FIG. 6A, the photoelectric element 401 outputs a light current for the intermediate transfer belt 101, as shown in FIG. 6B1. Next, when the light reflected from the patch 201 falls on the photoelectric element 401, and the light current output from the photoelectric element 401 becomes smaller. As the patch 201 departs from the photoelectric element 401, the light current comes close to the light current output for the intermediate transfer belt 101. Next, as shown in FIG. 6C1, the light current output from the photoelectric element 401 is converted into a voltage through I/V conversion, and a cross point between the voltage output from the photoelectric element 401 and a predetermined reference voltage Vref is detected as the position of the patch.

Figure 3:
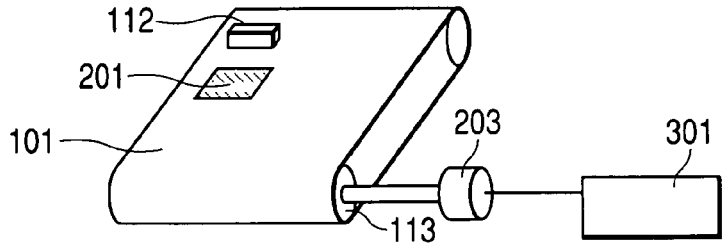
FIG. 3 is a block diagram of a belt unit drive section of the electrophotographic apparatus of the invention.
Figure 4A:
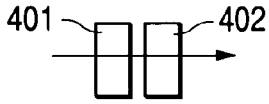
FIGS. 4A to 4D are views showing synchronous detection of a light beam of the electrophotographic apparatus of the invention.
Figure 4B:
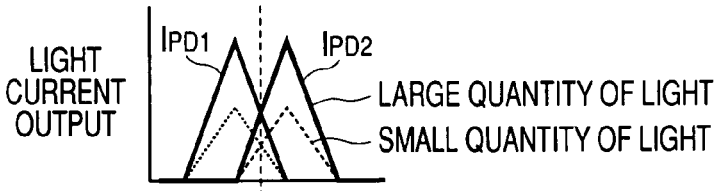
Figure 4C:
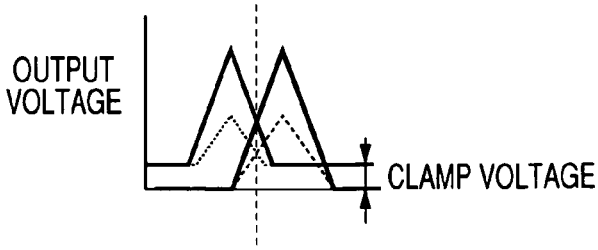
Figure 4D:
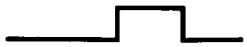

At this time, when the light reflected from the intermediate transfer belt 101 has changed in association with a change in the intermediate transfer belt 101; for example, when the quantity of the light reflected from the intermediate transfer belt 101 has become larger, as shown in FIG. 6B2, a cross point between the voltage output from the photoelectric element 401 and the predetermined reference voltage Vref can be detected as the position of the patch, as shown in FIG. 6C2. When the quantity of the light reflected from the intermediate transfer belt 101 has become smaller, as shown in FIG. 6B3, the cross point between the output voltage of the photoelectric element 401 and the predetermined reference voltage Vref does not appear, as shown in FIG. 6C3, so that the position of the patch cannot be detected.

Figure 7:
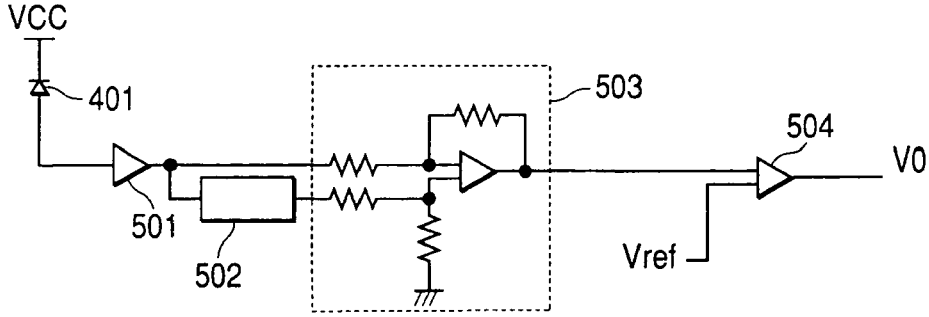
FIG. 7 is a circuit diagram of a registration patch detection circuit of the electrophotographic apparatus of the invention.
Figure 8A:
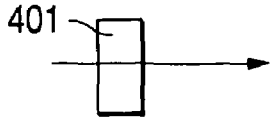
FIGS. 8A to 8E are views showing a registration patch detecting operation of the electrophotographic apparatus of the invention.
Figure 8B:
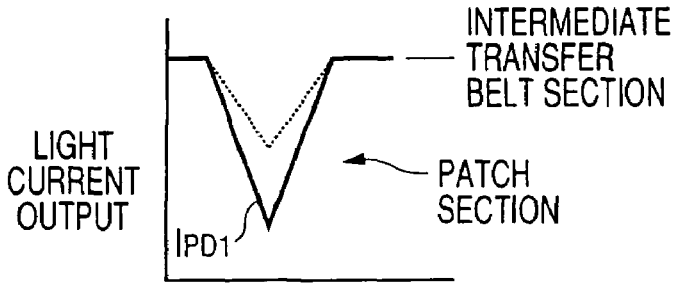
Figure 8C:
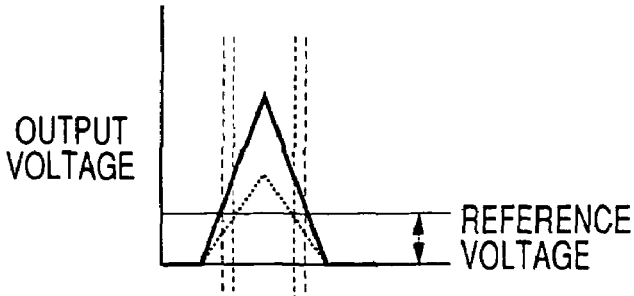
Figure 8D:
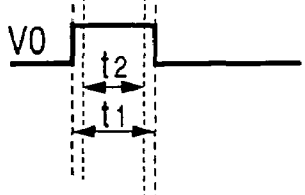
Figure 8E:
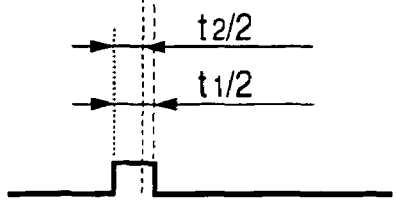

Below will be described detection of the registration patch which is not affected by the intermediate transfer belt and employs a difference between the light current output from the photoelectric element of the present embodiment for the intermediate transfer belt 101 and the light current output from the same for the patch 201. FIG. 7 is a circuit diagram of a patch position detection circuit of the present embodiment. Reference numeral 501 designates an operational amplifier; 502 designates a peak-hold circuit; 503 designates a differential amplifying circuit; and 504 designates a comparator. FIGS. 8A to 8E are views showing an operation for detecting the registration patch, showing operation of a circuit of the embodiment shown in FIG. 7. FIG. 8A shows how the light reflected from the patch 201 formed on the intermediate transfer belt 101 passes by the photoelectric element 401. FIG. 8B shows a relationship between passage of the reflected light and a light current $I_{PD1}$ output when the reflected light passes through the photoelectric element 401. FIG. 8C shows a relationship between the passage of the reflected light and an output voltage V3 formed by amplifying a difference between the output V1P for the intermediate transfer belt 101 and an output V1 for the patch 201. FIG. 8D shows a relationship between the passage of the reflected light and an output Vo detected as a cross point between the output V31 and the reference voltage Vref in connection with the quantity of light reflected from the patch 201. FIG. 8E shows a patch position signal for which an output time of the output Vo has been reduced by half.

As shown in FIG. 7, the light current output from the photoelectric element 401 is subjected to I/V conversion performed by the operational amplifier 501 and output as the voltage output V1. Next, the voltage output V1 is input to the peak-hold circuit 502, where the output is held at the voltage output from the intermediate transfer belt 101 and output as the output V1P. Next, a difference between the output voltage V1 that has undergone I/V conversion and the output voltage V1P of the peak-hold circuit is amplified by the differential amplifying circuit 503 by a factor of A, to thus produce a differentially-amplified output voltage V3=(V1P−V1)·A. This differentially-amplified output voltage is then input to the comparator 504. The comparator 504 compares the reference voltage Vref with the differentially-amplified output voltage V3, and, when the reference voltage $V_{REF}$ has exceeded V3, the output Vo is produced. An output time varies between $t_1$, $t_2$ in accordance with the quantity of light entering the photoelectric element 401. Therefore, the center position of the patch 201 can be detected by means of computing times $t_1/2$, $t_2/2$, each of which is half the output time Vo. Even when variations have arisen in the quantity of light entering the photoelectric element 401, the center position of the patch 201 remains unchanged, and hence the position of the patch can be detected with high accuracy.

According to the foregoing embodiment, detection of the patch position employs the difference between the output V1P for the intermediate transfer belt 101 and the output V1 for the patch 201, and hence the center position of the patch 201 is not affected by variations in the intermediate transfer belt 101 and remains unchanged, whereby the position of the patch can be detected with high accuracy.

Detection of the related-art registration patch performed by the image detection means in which the two photoelectric elements are arranged in the transport direction of the intermediate transfer belt will be described hereinbelow by reference to FIG. 9 and FIGS. 10A, 10B1 to 10B3, 10C1 to 10C3, and 10D1 to 10D3.

Figure 9:
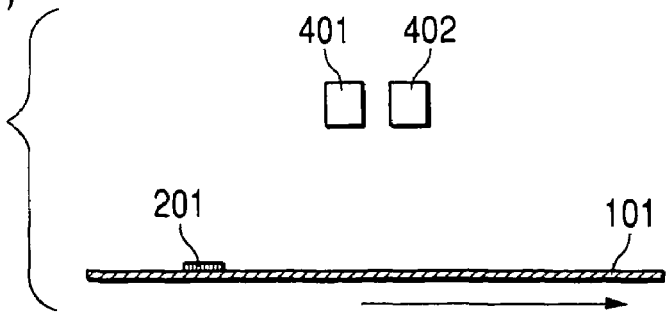
(RELATED ART) FIG. 9
FIG. 9 is a layout of related-art photoelectric elements.

FIG. 9 is a view showing the arrangement and configuration of the photoelectric elements. Reference numerals 401, 402 designate photoelectric elements, and the arrow provided in the drawing denotes the traveling direction of the patch 201. The photoelectric elements 401, 402 usually output light currents upon receipt of the light reflected from the intermediate transfer belt 101. At this time, the patch 201 formed on the intermediate transfer belt 101 is transported in the direction of the arrow. When the patch 201 has passed by the photoelectric elements 401, 402, the quantity of the light reflected from the patch 201, the patch being lower in reflectivity than the intermediate transfer belt 101, becomes smaller, whereupon the light currents output from the photoelectric elements 401, 402 also become smaller.

Figure 10A:
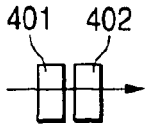
(RELATED ART) FIG. 10A
Figure 10A:
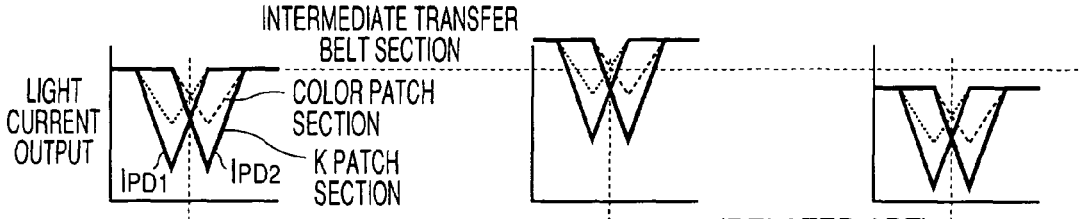
(RELATED ART) FIG. 10A
Figure 10A:
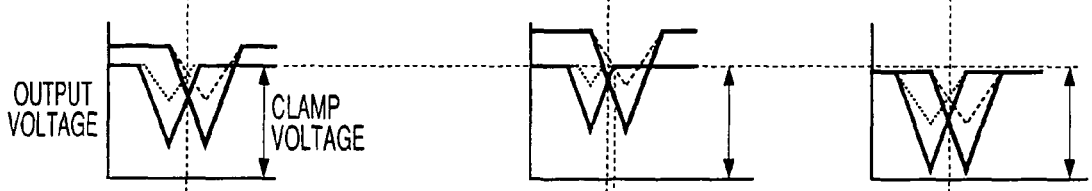
(RELATED ART) FIG. 10A
Figure 10A:
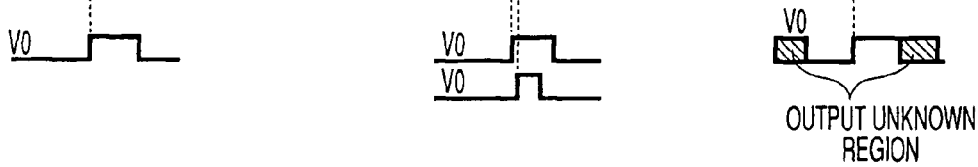
(RELATED ART) FIG. 10A

FIG. 10A, FIGS. 10B1 to 10B3, 10C1 to 10C3, and 10D1 to 10D3 are views showing operations of the photoelectric elements 401, 402 for detecting the position of a patch by means of the light currents. As shown in FIG. 10A, when the light reflected from the intermediate transfer belt 101 and the light reflected from the patch 201 pass by the photoelectric elements 401, 402 in the direction of the arrow, the photoelectric elements 401, 402 output light currents for the intermediate transfer belt 101, as shown in FIG. 10B1. Next, when the light reflected from the patch 201 falls on the photoelectric element 401, the light current output from the photoelectric element 401 becomes smaller. The light reflected from the patch 201 gradually departs from the photoelectric element 401 and enters the photoelectric element 402. At this time, the light current output from the photoelectric element 401 gradually increases to approach the photoelectric current output for the intermediate transfer belt 101, and an optical output from the photoelectric element 402 becomes smaller. As the light reflected from the patch 201 departs from the photoelectric element 402, the light current output from the photoelectric element 402 approaches the light current output for the intermediate transfer belt 101. When the position of the patch is detected at this point in time, a cross point between the light currents output from the photoelectric elements 401, 402 may be detected by means of the light current originating from the light reflected from the intermediate transfer belt 101, thereby failing to perform highly accurate detection. For this reason, after the light current output from the photoelectric element 401, on which the light reflected from the patch 201 enters first, has been converted into a voltage, the voltage is clamped at a predetermined voltage, as shown in FIG. 10C1, to thereby set an upper limit value. As a result, the cross point between the light currents output from the photoelectric elements 401, 402 becomes a single point, to thereby enable highly accurate detection of the patch position, as shown in FIG. 10D1.

However, when the light reflected from the intermediate transfer belt 101 has changed in association with a change in the intermediate transfer belt 101; for example, when the quantity of the light reflected from the intermediate transfer belt 101 has become greater, as shown in FIG. 10B2, the light currents output from the photoelectric elements 401, 402 cross each other at a position where the voltage exceeds the clamp voltage set to a predetermined voltage by means of the quantity of light reflected from the patch 201, as shown in FIG. 10C2, and the output Vo representing the position of the patch is output at a position other than the original cross point. As a result, an error arises in the position of the patch, thereby resulting in a failure to perform highly accurate detection. When the quantity of the light reflected from the intermediate transfer belt 101 has become smaller, as shown in FIG. 10B3, the light current of the light reflected from the intermediate transfer belt 101 becomes equal to or smaller than the clamp voltage, as shown in FIG. 10C3. The cross point between the light currents output from the photoelectric elements 401, 402 and the light current originating from the intermediate transfer belt are perceived as the position of the patch, thus failing to perform highly accurate detection.

Detection of the registration patch, which is not affected by the intermediate transfer belt and which is performed by the image detection means formed by arranging two photoelectric elements of the present embodiment in the transport direction of the intermediate transfer belt, will be described hereinbelow by reference to FIG. 11 and FIGS. 12A to 12E.

Figure 11:
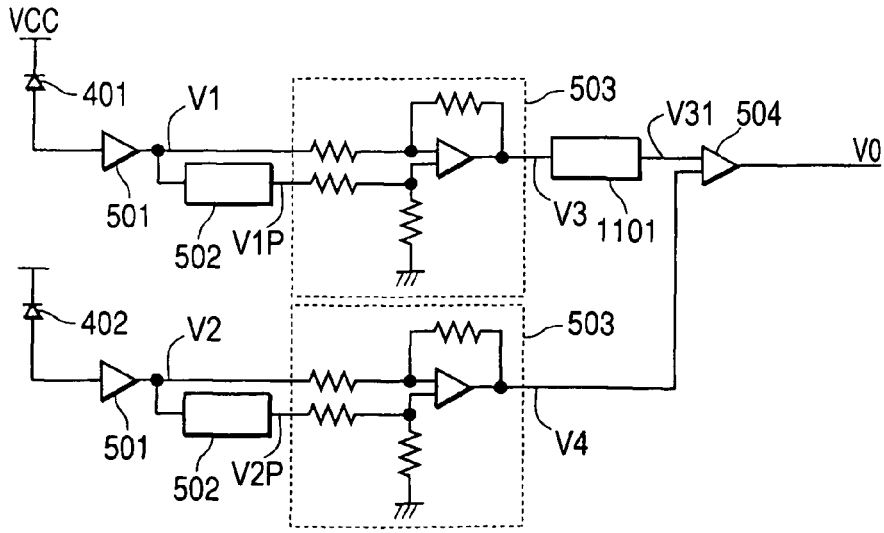
FIG. 11 is a circuit diagram of a registration patch detection circuit of the electrophotographic apparatus of the invention.
Figure 12A:
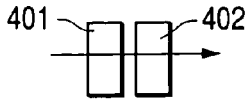
FIGS. 12A to 12E are views showing a registration patch detecting operation of the electrophotographic apparatus of the invention.
Figure 12B:
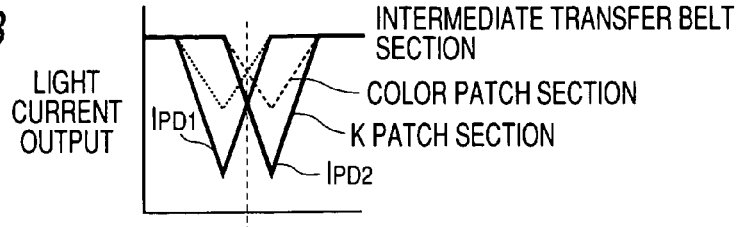
Figure 12C:
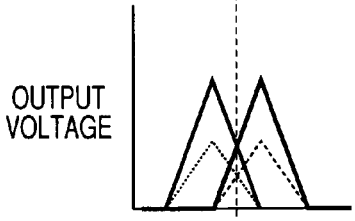
Figure 12D:
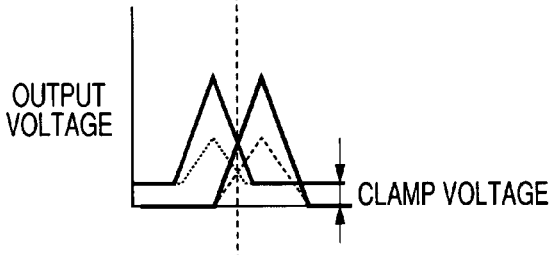
Figure 12E:
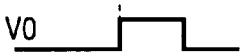

FIG. 11 is a circuit diagram of the patch position detection circuit of the embodiment. FIGS. 12A to 12E are views showing operation for detecting the position of a registration patch, showing operation of the circuit of the embodiment shown in FIG. 7. FIG. 12A shows how the light reflected from the patch 201 formed on the intermediate transfer belt 101 passes by the photoelectric elements 401, 402. FIG. 12B shows a relationship between the passage of the reflected light and light currents $I_{PD1}$, $I_{PD2}$ output when the reflected light passes by the photoelectric elements 401, 402. FIG. 12C shows a relationship between an output voltage V3, which is formed by amplifying a difference between the output V1P for the intermediate transfer belt 101 and the output V1 for the patch 201, and an output voltage V4, which is formed by amplifying a difference between an output V2P for the intermediate transfer belt 101 and an output V2 for the patch 201. FIG. 12D shows a relationship between the output voltage V31 for which the lower limit of the output V3 of the photoelectric element 401 is clamped and the output V4 of the photoelectric element 402. FIG. 12E shows a relationship between the passage of the reflected light and a patch position output VO detected as the cross point between the outputs V31, V4 in connection with the quantity of light reflected from the patch 201.

As shown in FIG. 11, the light currents output from the photoelectric elements 401, 402 are subjected to I/V conversion performed by the operational amplifiers 501, 501 and output as the voltage outputs V1, V2. Next, the voltages V1, V2 are input to the peak-hold circuits 502, 502, where the voltages are held at the output voltage for the intermediate transfer belt 101 and output as V1P, V2P, respectively. The differential amplifier circuits 503, 503 amplify a difference between the output voltage V1P of the peak-hold circuit and the output voltage V1 that has been subjected to I/V conversion and serves as a reference, by a factor of A, and the difference is then output as a differential amplifying output voltage V3=(V1P−V1)·A to the photoelectric element 401. The differential amplifier circuits 503, 503 also amplify a difference between the output voltage V2P of the peak-hold circuit and the output voltage V2 that has been subjected to I/V conversion and serves as a reference, by a factor of A, and the difference is then output as a differential amplifying output voltage V4=(V2P−V2)·A to the photoelectric element 402. Here, the output V3 is clamped by a clamp circuit 1101 such that the voltage output when the light reflected from the intermediate transfer belt 101 enters the photoelectric elements becomes equal to the predetermined voltage, and the output is produced as a clamp output V31 and input to the comparator 504.

Although a lower limit of the output V31 is limited by means of clamping, the portion of the output V31 that is higher than the clamp voltage becomes equal in waveform to the voltage output from the photoelectric element 40 in accordance with the quantity of incident light and is not affected by the clamp circuit 1101. For this reason, even when variations have arisen in the quantity of light entering the photoelectric elements 401, 402, the position where the cross point is detected remains unchanged, thereby enabling highly accurate detection. Moreover, no cross point appears for the outputs V3, V4 produced as a result of detection of the intermediate transfer belts 101, and hence faulty operation does not arise.

There are adopted the difference between the output V1P produced for the light reflected from the intermediate transfer belt 101 and the light V1 reflected from the patch 201 and the difference between the outputs V2P and V2. Hence, even when variations have arisen in the intermediate transfer belt 101 and variations have also arisen in the quantity of light entering the intermediate transfer belt 101, no variations arise in the output voltages originating from the intermediate transfer belt 101, the voltages being output as the outputs V3, V4, and the outputs do not exceed the clamp voltage. Therefore, the position where the cross point is detected does not change, and the position of the patch can be detected with high accuracy.

In the foregoing embodiment, the difference between the output VP1 for the intermediate transfer belt 101 and the output V1 of the patch 201 and the difference between the output V2P for the intermediate transfer belt 101 and the output V2 for the patch 201 are also used for detecting the position of the patch. Hence, the position where the cross point is to be detected is not affected by variations in the intermediate transfer belt and does not change, and hence the position of the patch can be detected with high accuracy.

A method of the detection means will now be described by reference to FIGS. 13A and 13B.

Figure 13A:
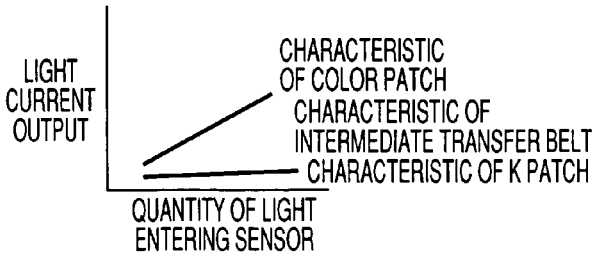
FIGS. 13A and 13B are views showing a sensor light current output characteristic with respect to the quantity of light entering the sensor of the electrophotographic apparatus of the invention.
Figure 13B:
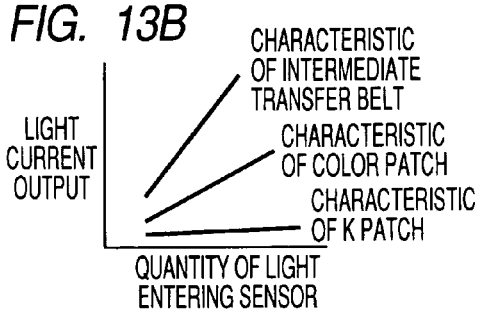

FIGS. 13A and 13B are views showing a relationship between the quantity of light entering the sensor of the embodiment and the light current, wherein the horizontal axis shows the quantity of light entering the photoelectric element, and the vertical axis shows the light currents output from the photoelectric elements. FIG. 13A shows a case where diffused light has been detected by the photoelectric elements. FIG. 13B shows a case where the light that has undergone regular reflection is detected by the photoelectric elements.

The patch detection method of the embodiment will be described hereinbelow. As shown in FIG. 13A, when diffused light reflected from the intermediate transfer belt and the patch is detected by the photoelectric elements, light currents produced from the light reflected from the color patches (yellow, magenta, and cyan) are large, and a light current reflected from the K patch (black) and that reflected from the intermediate transfer belt cannot be detected. The reason for this is attributable to reflection characteristics of colors, and black is incapable of diffusing or reflecting light. Therefore, in order to detect the patches by means of diffused, reflected light, a color patch having different reflectivity must be formed below the K patch for detecting the K patch.

As shown in FIG. 13B, when the photoelectric elements have detected the light that has undergone regular reflection on the intermediate transfer belt and the patch, the light current output for the intermediate transfer belt is large; the light currents output for the color patches (i.e., the yellow, magenta, and cyan) are intermediate; and the light current output for the K patch (black) is small. When the relationship between the intermediate transfer belt and the toner in terms of reflectivity is defined as the intermediate transfer belt>the toner, a toner image having low reflectivity is formed on the intermediate transfer belt. As a result, the quantity of reflected light becomes smaller in a toner image section. During detection of the patch, an absolute value of the quantity of reflected light is not required, and the patch can be detected by means of only a difference in the quantity of light reflected from the intermediate transfer belt and the quantity of light reflected from the patch.

According to the foregoing embodiment, the light reflected from the intermediate transfer belt and that reflected from the patch are detected in the form of regular reflected light. As a result, the intermediate transfer belt and the K patch can be distinguished from each other, and there is yielded an effect of the ability to detect the amount of registration offset without involvement of an increase in the quantity of toner consumption.

A method for setting the clamp voltage will be described by reference to FIGS. 12 to 14.

Figure 14:
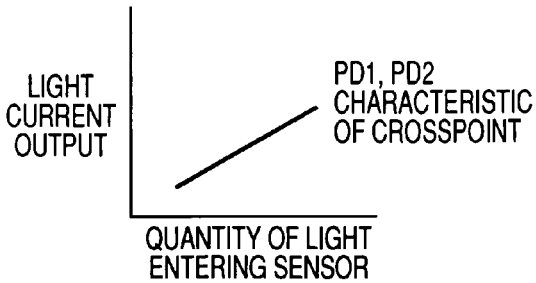
FIG. 14 is a view showing a shift of a cross point in connection within the quantity of light entering the sensor of the electrophotographic apparatus of the invention.

FIG. 14 is a view showing a relationship between the quantity of light entering the sensor of the present embodiment and the cross point between the light currents, wherein the horizontal axis shows the quantity of light entering the photoelectric elements; and the vertical axis shows a cross point existing between the light currents output from the photoelectric elements 401, 402. When an output from the photoelectric element 402 is changed by noise, a clamp voltage which is higher in level than the noise expected to arise in the output from the photoelectric element 401 is set, as shown in FIG. 12D. As a result, even when there is noise which is lower than or equal to the clamp voltage, the outputs from the photoelectric elements 401, 402 do not cross each other, thereby yielding no faulty operation. Moreover, as shown in FIG. 14, the cross point between the outputs from the photoelectric elements 401, 402 change in accordance with the quantity of light entering the sensor. As shown in FIG. 13B, the electric currents achieved at the time of detection of the K patch and the electric current achieved at the time of detection of the color patches differ from each other. Hence, the position of the cross point also changes in accordance with the color of the patch 201, and the clamp voltage is set to become equal to or lower than the cross point between the electric currents output from the photoelectric currents 401, 402, whereupon the position where the cross point is to be detected is not affected by variations in the quantity of light entering the sensor, and hence the position of the patch can be detected with high accuracy.

According to the previously-described embodiment, as a result of the clamp voltage being set so as to become equal to or higher than the expected noise or equal to or lower than the cross point achieved at the time of detection of the patch, the position where the cross point is to be detected remains unchanged, so that the position of the patch can be detected with high accuracy without being affected by the quantity of light entering the sensor.

What is claimed is:

1. An electrophotographic apparatus comprising:

a plurality of image forming units which:

electrify a photosensitive member, form electrostatic images, each being made up of an electrification potential portion and a discharge potential portion, on said photosensitive member by an exposure unit, and develop said electrostatic latent images with toner, to thus form toner images on said photosensitive member;

an intermediate transfer belt on which said toner images of different colors formed on said photosensitive member are sequentially transferred in an overlapping manner by said respective image forming units; and an image detector for detecting registration patches formed on said intermediate transfer belt with said color toner images, registration correction control for aligning positions of said color toner images being employed, wherein said image detector comprises:

an I/V converter for converting, into a voltage output, a current output as a result of a photoelectric element arranged in a traveling direction of said intermediate transfer belt receiving light reflected from said intermediate transfer belt and light reflected from said toner images formed on said intermediate transfer belt;

a peak-hold unit for holding an output voltage into which said light reflected from said intermediate transfer belt has been converted by said I/V converter; and a computation unit for detecting a difference between said output voltage of the said peak-hold unit and an output voltage into which said light reflected from said toner images of respective colors is converted by said IV converter.

2. The electrophotographic apparatus according to claim 1, wherein said image detector includes two photoelectric elements and further comprises:

a clamper for preventing an output voltage of said photoelectric element which first receives said light reflected from said toner images from falling to or below a predetermined voltage; and a comparator for comparing a clamp section output voltage with an output voltage of said computation section of said other photoelectric element, to thus output a timing signal showing the positions of said toner images.

3. The electrophotographic apparatus according to claim 1, wherein said image detector includes a light source and two photoelectric elements, and said photoelectric elements are arranged to receive light which has originated from the light source and has undergone regular reflection on said intermediate transfer belt and regular reflection on said color toner images formed thereon.

4. The electrophotographic apparatus according to claim 1, wherein said image detector further comprises:

a comparator that outputs a timing signal by comparing a reference voltage with said difference between said output voltage of the said peak-hold unit and an output voltage into which said light reflected from said toner images of respective colors is converted by said I/V converter.

5. The electrophotographic apparatus according to claim 4, wherein a center position of said toner images is calculated by dividing said output timing signal in half.

6. The electrophotographic apparatus according to claim 1, wherein a center position of said toner images is determined based on said difference between said output voltage of said peak-hold unit and an output voltage into which said light reflected from said toner images of respective colors is converted by said I/V converter.

7. The electrophotographic apparatus according to claim 2, wherein said clamper is arranged such that said comparator brings a clamp voltage to an electric potential which is equal to or less than a potential at which said clamp section output voltage and said output voltage of said computation section cross each other.

8. An electrophotographic apparatus comprising:

a plurality of image forming units which electrify a photosensitive member that forms electrostatic images to thus form toner images on said photosensitive member;

an intermediate transfer belt on which said toner images of different colors formed on said photosensitive member are sequentially transferred in an overlapping manner by said respective image forming units; and a registration correction control unit that aligns positions of said color toner images, wherein said registration correction control unit comprises:

an I/V converter that converts, into a voltage output, a current output as a result of a photoelectric element arranged in a traveling direction of said intermediate transfer belt receiving light reflected from said intermediate transfer belt and light reflected from said toner images formed on said intermediate transfer belt;

a peak-hold unit that holds an output voltage into which said light reflected from said intermediate transfer belt has been converted by said I/V converter; and a computation unit that detects a difference between said output voltage of said peak-hold unit and an output voltage into which said light reflected from said toner images of respective colors is converted by said I/V converter.

9. The electrophotographic apparatus according to claim 8, wherein said registration correction control unit includes two photoelectric elements and further comprises:

a clamper prevents an output voltage of said photoelectric element which first receives said light reflected from said toner images from falling to or below a predetermined voltage; and a comparator that compares a clamp section output voltage with an output voltage of said computation section of said other photoelectric element, to thus output a timing signal showing the positions of said toner images.

10. The electrophotographic apparatus according to claim 8, wherein said registration correction control unit includes a light source and two photoelectric elements, and said photoelectric elements are arranged to receive light which has originated from the light source and has undergone regular reflection on said intermediate transfer belt and regular reflection on said color toner images formed thereon.

11. The electrophotographic apparatus according to claim 8, wherein said registration correction control unit further comprises:

a comparator that outputs a timing signal by comparing a reference voltage with said difference between said output voltage of the said peak-hold unit and an output voltage into which said light reflected from said toner images of respective colors is converted by said I/V converter.

12. The electrophotographic apparatus according to claim 9, wherein said clamper is arranged such that said comparator brings a clamp voltage to an electric potential which is equal to or less than a potential at which said clamp section output voltage and said output voltage of said computation section cross each other.

13. The electrophotographic apparatus according to claim 11, wherein a center position of said toner images is calculated by dividing said output timing signal in half.

14. An electrophotographic apparatus comprising:

a plurality of image forming units which electrify a photosensitive member, form electrostatic images on the photosensitive member, and develop the electrostatic latent images to form toner images;

an intermediate transfer belt on which said toner images of different colors formed on said photosensitive member are sequentially transferred in an overlapping manner by said respective image forming units; and a registration correction control unit that aligns positions of said color toner images, wherein said registration correction control unit comprises:

two photoelectric elements;

two I/V converters that convert, into a voltage output, a current output with respect to each of said photoelectric elements arranged in a traveling direction of said intermediate transfer belt receiving light reflected from said intermediate transfer belt and light reflected from said toner images formed on said intermediate transfer belt;

two peak-hold units that hold output voltages into which said light reflected from said intermediate transfer belt has been converted by each of said two I/V converters; and two computation units that detect differences between each of said output voltages of said two peak-hold units and both output voltages into which said light reflected from said toner images of respective colors is converted by each of said two I/V converters.

15. The electrophotographic apparatus according to claim 14, further comprising:

a clamper that prevents either output voltage of said two photoelectric elements which first receives said light reflected from said toner images from falling to or below a predetermined voltage; and a comparator that compares a clamp section output voltage with an output voltage of said computation section of said other photoelectric element, to thus output a timing signal showing the positions of said toner images.

16. The electrophotographic apparatus according to claim 14, wherein said registration correction control unit includes a light source, and said two photoelectric elements are arranged to receive light which has originated from the light source and has undergone regular reflection on said intermediate transfer belt and regular reflection on said color toner images formed thereon.

17. The electrophotographic apparatus according to claim 14, wherein said registration correction control unit further comprises:

a comparator that outputs a timing signal by comparing, a first difference from a first of said two computation units between a first output voltage of a first of said two peak-hold units and an output voltage into which said light reflected from said toner images of respective colors is converted by a first of said two I/V converters, with a second difference from a second of said two computation units between said a second output voltage of said peak-hold units and an output voltage into which said light reflected from said toner images of respective colors is converted by a second of said two I/V converters.

18. The electrophotographic apparatus according to claim 14, wherein, a first difference between:

a voltage output from a first of said two I/V converters; and an output voltage from a first of said two peak-hold units; and a second difference between:

a voltage output from a second of said two I/V converters; and an output voltage from a second of said two peak-hold units; are used to detect a position of a toner image.

19. The electrophotographic apparatus according to claim 15, wherein said clamper is arranged such that said comparator brings a clamp voltage to an electric potential which is equal to or less than a potential at which said clamp section output voltage and said output voltage of said computation section cross each other.

20. The electrophotographic apparatus according to claim 17, wherein a center position between two toner images is determined by said timing signal.

* * * * *